US011137136B1

(12) United States Patent
Hsu

(10) Patent No.: US 11,137,136 B1
(45) Date of Patent: Oct. 5, 2021

(54) UMBRELLA ACOUSTICS LAMP

(71) Applicant: Dong Guan Jia Sheng Lighting Technology Co., Ltd. China, Dong-Guna (CN)

(72) Inventor: Kevin Hsu, Taichung (TW)

(73) Assignee: Dong Guan Jia Sheng Lighting Technology Co., Ltd. China, Guang-Dong (CN)

( * ) Notice: Subject to any disclaimer, the term of this patent is extended or adjusted under 35 U.S.C. 154(b) by 0 days.

(21) Appl. No.: 15/930,517

(22) Filed: May 13, 2020

(51) Int. Cl.
*F21V 33/00* (2006.01)
*A45B 25/00* (2006.01)

(52) U.S. Cl.
CPC ..... *F21V 33/0056* (2013.01); *A45B 25/00* (2013.01); *A45B 2025/003* (2013.01)

(58) Field of Classification Search
CPC ..... A45B 2025/003; A45B 3/04; A45B 25/00
See application file for complete search history.

(56) References Cited

U.S. PATENT DOCUMENTS 4,872,468 A * 10/1989 Cole ..... A45B 3/04 135/16
5,707,135 A * 1/1998 Miller, Jr. ..... A45B 3/04 362/102
5,816,685 A * 10/1998 Hou ..... A45B 3/02 362/205
8,353,080 B2 * 1/2013 Huang ..... B25G 1/06 16/110.1
9,185,988 B1 * 11/2015 Sanchez ..... A47C 7/72
10,010,143 B2 * 7/2018 Kong ..... H04B 1/08

FOREIGN PATENT DOCUMENTS

FR 2666968 A1 * 3/1992 ..... A45B 3/04

* cited by examiner

*Primary Examiner* — Noah Chandler Hawk
(74) *Attorney, Agent, or Firm* — Karin L. Williams; Alan D. Kamrath; Mayer & Williams PC

(57) ABSTRACT

An umbrella acoustics lamp includes a housing, an acoustics device mounted in the housing, and a lighting device mounted in the housing. The housing has a receiving space. The acoustics device is mounted in the receiving space and includes a battery, a circuit board, a speaker, and a speaker rack. The speaker rack is secured in the receiving space. The speaker is mounted on the speaker rack. The lighting device is mounted in the receiving space and includes a base, a light source, a reflector, a light output board, and a washer. The base is secured to and located under the speaker rack. The base is provided with a receiving chamber. The light output board, the washer, and the reflector are in turn received in the receiving chamber. The light source is located above the base.

7 Claims, 6 Drawing Sheets

UMBRELLA ACOUSTICS LAMP

BACKGROUND OF THE INVENTION

1. Field of the Invention

The present invention relates to an illuminating apparatus and, more particularly, to an umbrella acoustics lamp.

2. Description of the Related Art

An umbrella is used to protect a user from rain or sun. However, the conventional umbrella only has a single function, and cannot provide sounding, lighting, and charging functions, thereby greatly limiting the versatility of the umbrella.

BRIEF SUMMARY OF THE INVENTION

The primary objective of the present invention is to provide an umbrella acoustics lamp that is available for multiple purposes.

In accordance with the present invention, there is provided an umbrella acoustics lamp comprising a housing, an acoustics device mounted in the housing, and a lighting device mounted in the housing. The housing has an interior provided with a receiving space. The acoustics device is mounted in the receiving space of the housing and includes a battery, a circuit board, a speaker, and a speaker rack. The speaker rack is secured in the receiving space of the housing. The speaker is mounted on the speaker rack. The lighting device is mounted in the receiving space of the housing and includes a base, a light source, a reflector, a light output board, and a washer. The base is secured to and located under the speaker rack. The base is provided with a receiving chamber. The light output board, the washer, and the reflector are in turn received in the receiving chamber of the base. The light source is located above the base.

According to the primary advantage of the present invention, the umbrella acoustics lamp is mounted on the umbrella shank such that the umbrella acoustics lamp can function as a handle of an umbrella.

According to another advantage of the present invention, the umbrella acoustics lamp provides sounding, lighting, and charging functions, thereby enhancing the versatility of the umbrella acoustics lamp, and thereby facilitating the user using the umbrella acoustics lamp.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
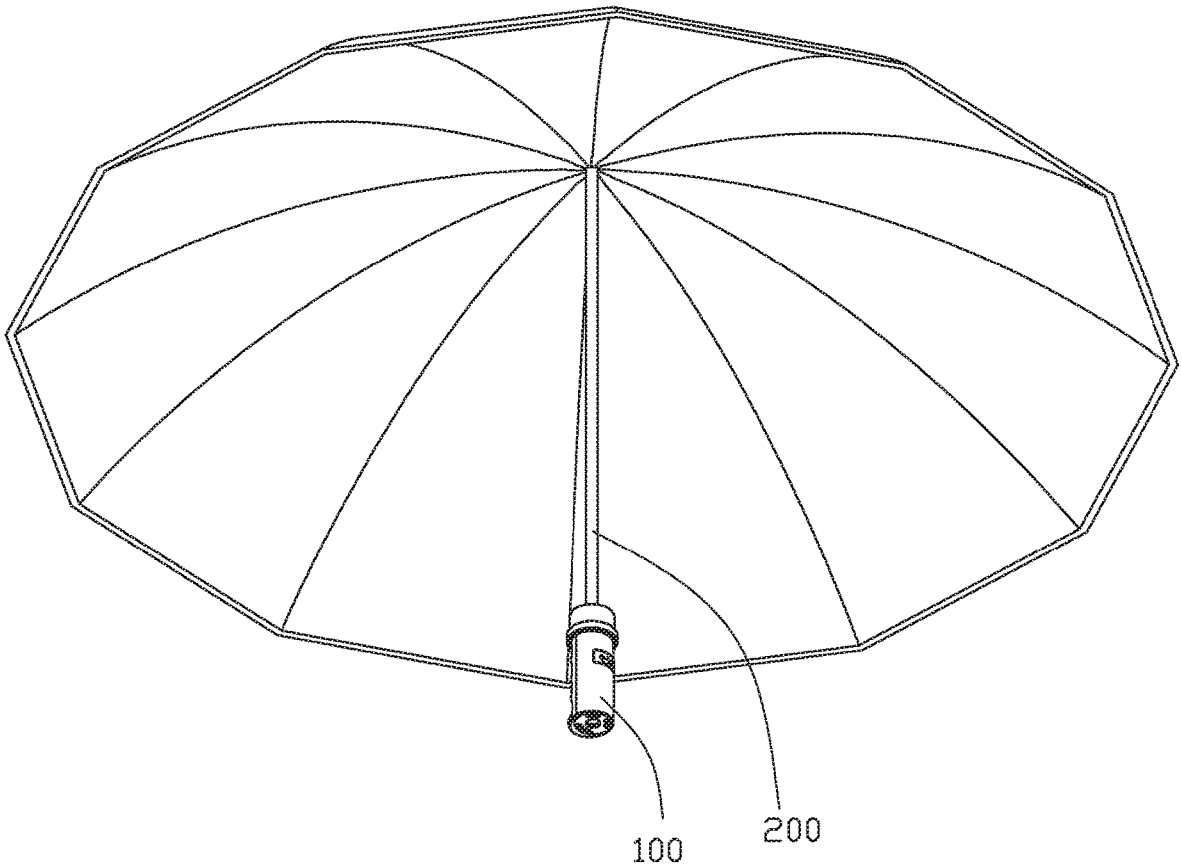
FIG. 1 is a perspective view of an umbrella acoustics lamp in accordance with the preferred embodiment of the present invention, wherein the umbrella acoustics lamp is mounted on an umbrella shank.
Figure 2:
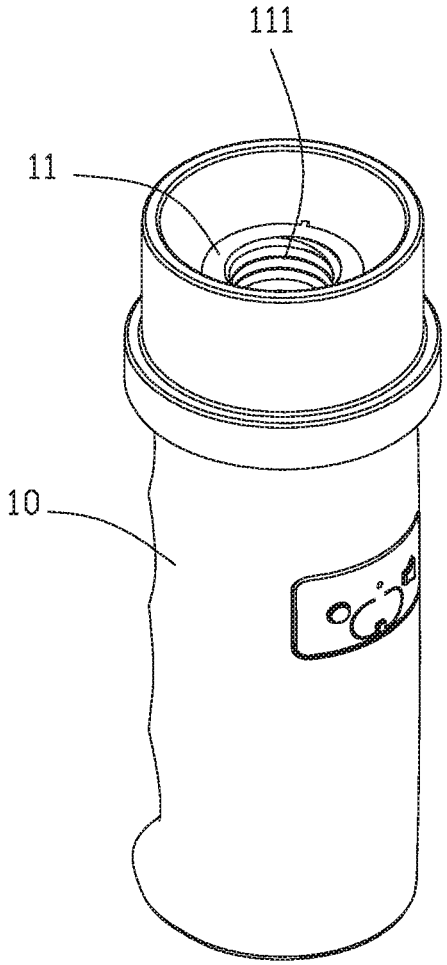
FIG. 2 is a perspective view of the umbrella acoustics lamp in accordance with the preferred embodiment of the present invention.
Figure 3:
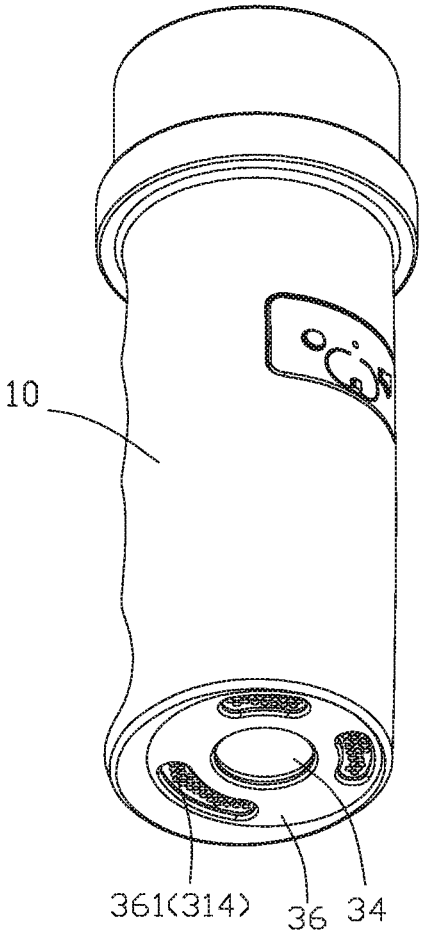
FIG. 3 is another perspective view of the umbrella acoustics lamp in accordance with the preferred embodiment of the present invention.
Figure 4:
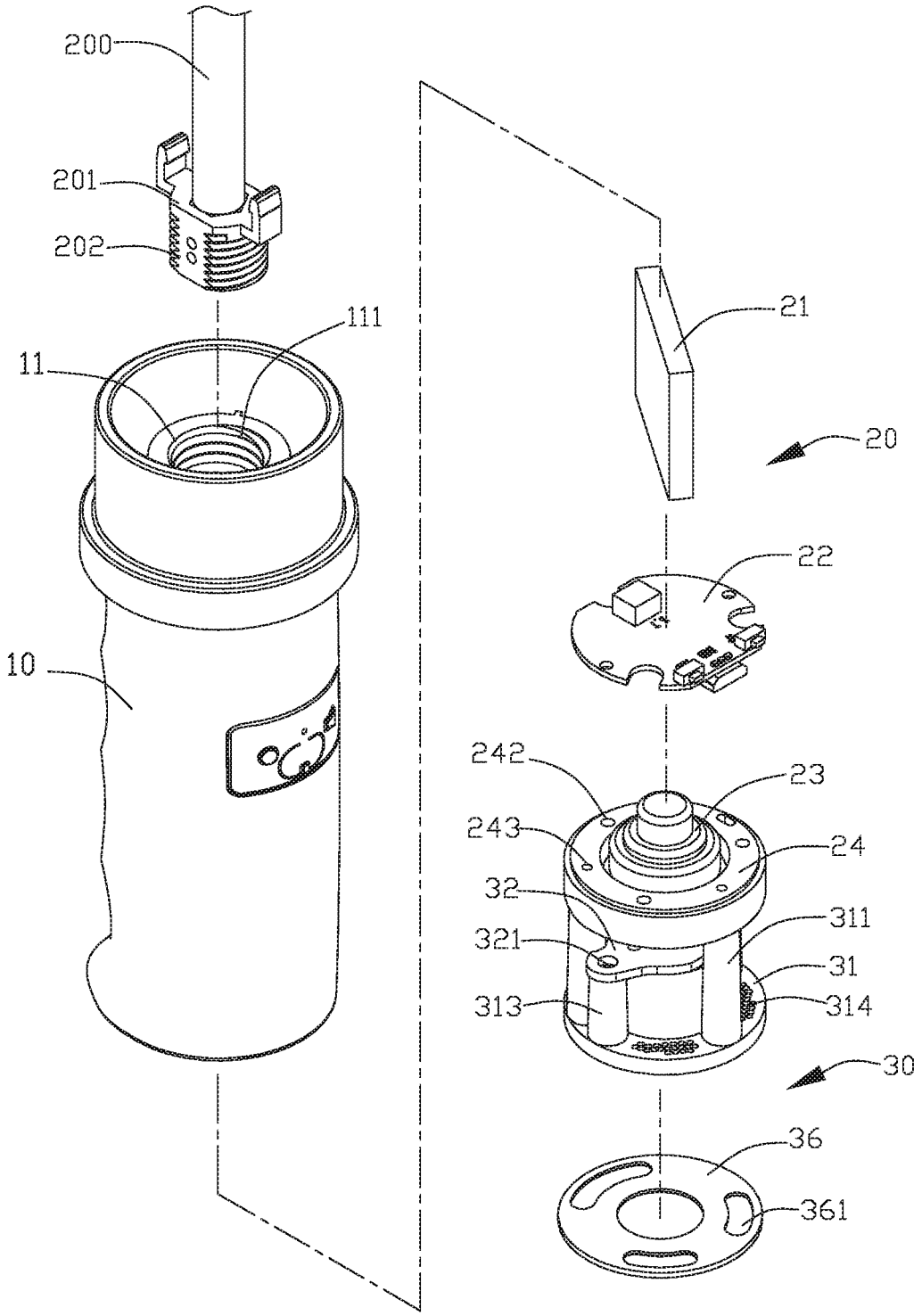
FIG. 4 is a partial exploded perspective view of the umbrella acoustics lamp in accordance with the preferred embodiment of the present invention.
Figure 5:
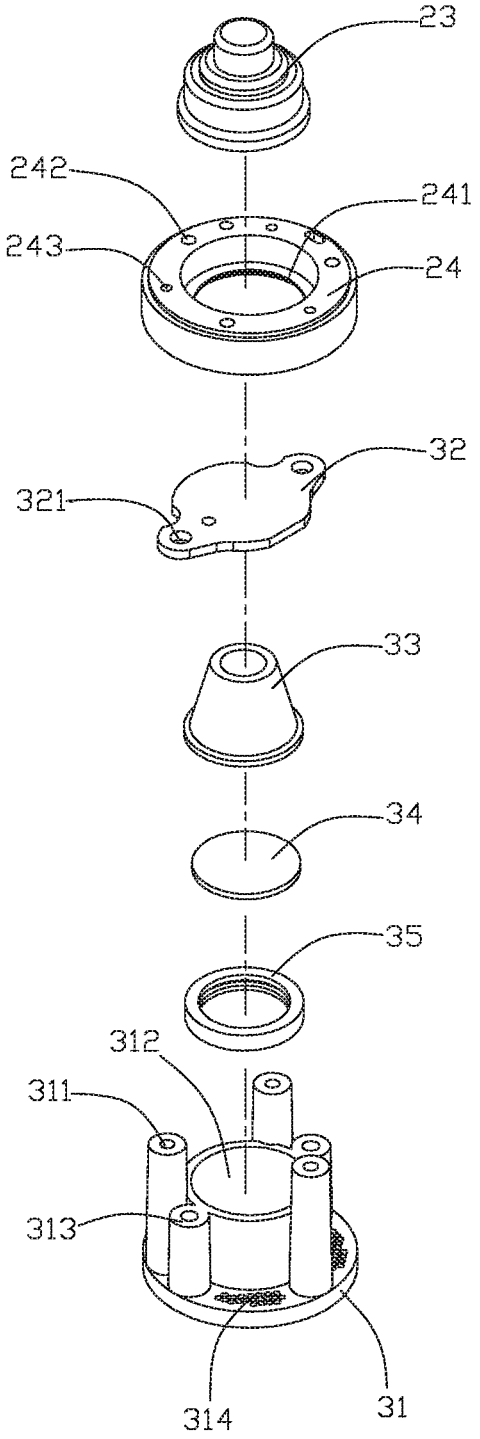
FIG. 5 is another partial exploded perspective view of the umbrella acoustics lamp in accordance with the preferred embodiment of the present invention.
Figure 6:
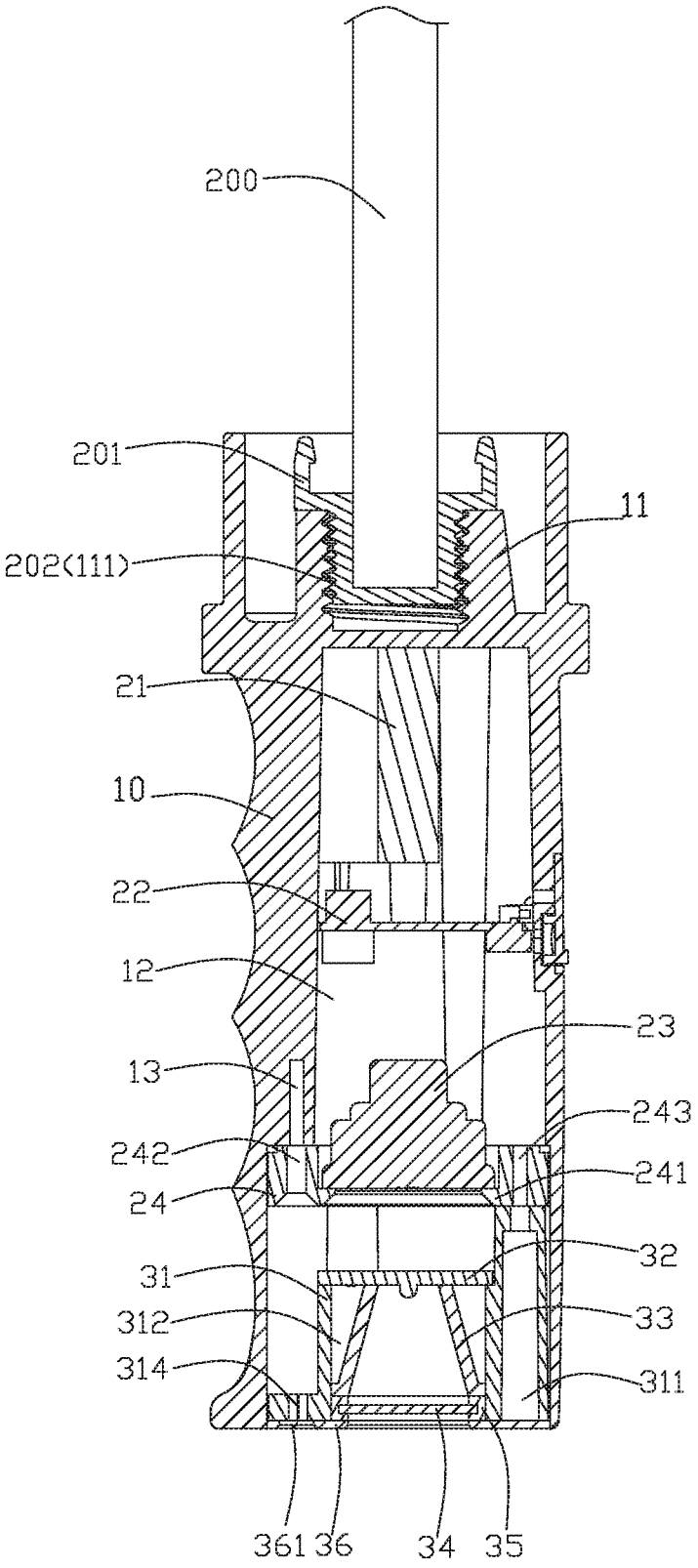
FIG. 6 is a cross-sectional view of the umbrella acoustics lamp in accordance with the preferred embodiment of the present invention.

Referring to FIGS. 1-6, an umbrella acoustics lamp 100 in accordance with the preferred embodiment of the present invention is mounted on an umbrella shank 200 of an umbrella and comprises a housing 10, an acoustics device 20 mounted in the housing 10, and a lighting device 30 mounted in the housing 10.

The housing 10 has an interior provided with a receiving space 12.

The acoustics device 20 is mounted in the receiving space 12 of the housing 10 and includes a battery 21, a circuit board 22, a speaker 23, and a speaker rack 24. The speaker rack 24 is secured in the receiving space 12 of the housing 10. The speaker 23 is mounted on the speaker rack 24. The battery 21 supplies an electric power to the circuit board 22 and the speaker 23. The circuit board 22 is used to receive, operate, and control a sound source.

The lighting device 30 is mounted in the receiving space 12 of the housing 10 and includes a base 31, a light source 32, a reflector 33, a light output board 34, and a washer 35. The base 31 is secured to and located under the speaker rack 24. The base 31 is provided with a receiving chamber 312. The light output board 34, the washer 35, and the reflector 33 are in turn received in the receiving chamber 312 of the base 31. The light source 32 is located above the base 31. The light ray of the light source 32 is diffused outward toward the reflector 33, the light output board 34, and the receiving chamber 312 of the base 31, to provide an illuminating function.

In the preferred embodiment of the present invention, the receiving space 12 of the housing 10 is provided with at least one threaded fitting hole 13, the speaker rack 24 is provided with at least one through hole 242 aligning with the at least one fitting hole 13 of the housing 10, and at least one screw extends through the at least one through hole 242 of the speaker rack 24 and is screwed into the at least one fitting hole 13 of the housing 10, to secure the speaker rack 24 to the housing 10.

In the preferred embodiment of the present invention, the speaker rack 24 has an annular shape and is provided with a stop flange 241 extending radially inward, and the speaker 23 is received in the speaker rack 24 and supported by the stop flange 241. The stop flange 241 has an inner diameter smaller than an outer diameter of the speaker 23.

In the preferred embodiment of the present invention, the speaker rack 24 is provided with a plurality of threaded perforations 243, the base 31 is provided with a plurality of hollow pillars 311 abutting the speaker rack 24 and aligning with the perforations 243 of the speaker rack 24, and a plurality of screws extend through the pillars 311 of the base 31 and are screwed into the perforations 243 of the speaker rack 24, to secure the base 31 to a bottom of the speaker rack 24.

In the preferred embodiment of the present invention, the lighting device 30 further includes a bottom plate 36 secured to a bottom to the housing 10. The bottom plate 36 is provided with a plurality of slots 361. The base 31 is provided with a plurality of sound output holes 314 aligning with the slots 361 of the bottom plate 36. The voice of the speaker 23 is delivered through the sound output holes 314 of the base 31 and the slots 361 of the bottom plate 36, and is diffused outward, to provide a sounding function.

In the preferred embodiment of the present invention, the light output board 34 is secured in the washer 35.

In the preferred embodiment of the present invention, the light source 32 is provided with a plurality of screw holes 321, the base 31 is provided with a plurality of hollow columns 313 abutting the light source 32 and aligning with the screw holes 321 of the light source 32, and a plurality of screws extend through the columns 313 of the base 31 and are screwed into the screw holes 321 of the light source 32, to secure the light source 32 to the base 31. Thus, the light source 32 is supported by the columns 313 of the base 31.

In the preferred embodiment of the present invention, the umbrella shank 200 has an end provided with a first mounting portion 201, and the housing 10 has a top provided with a second mounting portion 11 mounted on the first mounting portion 201 of the umbrella shank 200. The first mounting portion 201 of the umbrella shank 200 is provided with an external thread 202. The second mounting portion 11 of the housing 10 has a top provided with threaded hole 111 screwed onto the external thread 202 of the first mounting portion 201, to secure the second mounting portion 11 of the housing 10 to the first mounting portion 201 of the umbrella shank 200.

In the preferred embodiment of the present invention, the housing 10 further provided with a control button module and a charging interface. A waterproof gasket is mounted on the control button module and the charging interface. The control button module includes function buttons and locking buttons. The function buttons are used to control on/off, brightness, volume, and audio switching of the acoustics device 20 and the lighting device 30. The locking buttons are used to lock the function buttons, to prevent the function buttons from being triggered inadvertently.

Accordingly, the umbrella acoustics lamp 100 is mounted on the umbrella shank 200 such that the umbrella acoustics lamp 100 can function as a handle of an umbrella. In addition, the umbrella acoustics lamp 100 provides sounding, lighting, and charging functions, thereby enhancing the versatility of the umbrella acoustics lamp 100, and thereby facilitating the user using the umbrella acoustics lamp 100.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. An umbrella acoustics lamp comprising:
a housing;
an acoustics device mounted in the housing; and
a lighting device mounted in the housing;
wherein:
the housing has an interior provided with a receiving space;
the acoustics device is mounted in the receiving space of the housing and includes a battery, a circuit board, a speaker, and a speaker rack;
the speaker rack is secured in the receiving space of the housing;
the speaker is mounted on the speaker rack;
the lighting device is mounted in the receiving space of the housing and includes a base, a light source, a reflector, a light output board, and a washer;
the base is secured to and located under the speaker rack;
the base is provided with a receiving chamber;
the light output board, the washer, and the reflector are in turn received in the receiving chamber of the base;
the light source is located above the base;
the receiving space of the housing is provided with at least one threaded fitting hole;
the speaker rack is provided with at least one through hole aligning with the at least one fitting hole of the housing; and
at least one screw extends through the at least one through hole of the speaker rack and is screwed into the at least one fitting hole of the housing.

2. The umbrella acoustics lamp as claimed in claim 1, wherein:
the speaker rack is provided with a stop flange;
the speaker is supported by the stop flange; and
the stop flange has an inner diameter smaller than an outer diameter of the speaker.

3. The umbrella acoustics lamp as claimed in claim 1, wherein:
the speaker rack is provided with a plurality of threaded perforations;
the base is provided with a plurality of hollow pillars abutting the speaker rack and aligning with the perforations of the speaker rack; and
a plurality of screws extend through the pillars of the base and are screwed into the perforations of the speaker rack.

4. The umbrella acoustics lamp as claimed in claim 1, wherein:
the lighting device further includes a bottom plate secured to a bottom to the housing;
the bottom plate is provided with a plurality of slots; and
the base is provided with a plurality of sound output holes aligning with the slots of the bottom plate.

5. The umbrella acoustics lamp as claimed in claim 1, wherein the light output board is secured in the washer.

6. The umbrella acoustics lamp as claimed in claim 1, wherein:
the light source is provided with a plurality of screw holes;
the base is provided with a plurality of hollow columns abutting the light source and aligning with the screw holes of the light source; and
a plurality of screws extend through the columns of the base and are screwed into the screw holes of the light source.

7. The umbrella acoustics lamp as claimed in claim 1, wherein:
the umbrella acoustics lamp is mounted on an umbrella shank;
the umbrella shank has an end provided with a first mounting portion;
the housing has a top provided with a second mounting portion mounted on the first mounting portion of the umbrella shank;
the first mounting portion of the umbrella shank is provided with an external thread; and
the second mounting portion of the housing has a top provided with threaded hole screwed onto the external thread of the first mounting portion.

* * * * *